United States Patent [19]

Dahlgren

[11] Patent Number: 4,919,636

[45] Date of Patent: Apr. 24, 1990

[54] WATER TOY

[76] Inventor: Lennart Dahlgren, Askims Utsiktsväg 10, S-436 00 Askim, Sweden

[21] Appl. No.: 306,935

[22] Filed: Feb. 6, 1989

[30] Foreign Application Priority Data

Feb. 4, 1988 [DE] Fed. Rep. of Germany ..... 3803306

[51] Int. Cl.[5] ..... A63H 23/00; A63H 29/10; A63H 3/18

[52] U.S. Cl. ..... 446/159; 446/167; 446/177; 446/322

[58] Field of Search ..... 446/153, 156, 157, 158, 446/159, 166, 167, 168, 169, 177, 90, 199, 322, 176; 273/349, DIG. 25

[56] References Cited

U.S. PATENT DOCUMENTS

| | | | |
|---|---|---|---|
| 362,421 | 5/1887 | Buddington | 446/166 |
| 387,497 | 8/1888 | Demarest | 446/166 |
| 1,226,155 | 5/1917 | Wilhelm et al. | 446/166 |
| 1,425,865 | 8/1922 | Kehl | 446/166 |
| 1,450,375 | 4/1923 | Kehl | 446/166 |
| 2,195,311 | 3/1940 | Hurst | 446/322 X |
| 2,439,800 | 4/1948 | Fisher | 446/166 |
| 3,577,675 | 5/1971 | Kohner | 446/177 X |
| 3,665,638 | 5/1972 | Weistrop | 446/166 |
| 4,206,565 | 6/1980 | Goldfarb | 446/167 |

*Primary Examiner*—Mickey Yu
*Assistant Examiner*—D. Neal Muir
*Attorney, Agent, or Firm*—Ostrolenk, Faber, Gerb & Soffen

[57] ABSTRACT

An educational water toy for children, which incorporates a first water tank (1) fitted to a base plate (2) and having at least one outlet opening (21, 22). The base plate further has additional water tanks (3, 4) provided below the outlet opening (21, 22) and preferably designed as figures (31, 41), which are freely pivotably supported about a pivot axis (33, 43) extending perpendicularly to the base plate (1), in such a manner, that it in unfilled condition is in a balanced position, and that in at least partly filled condition by means of unbalance pivots to a tilting position, in which it is emptied. By a repetition of this process a rocking motion is obtained.

24 Claims, 1 Drawing Sheet

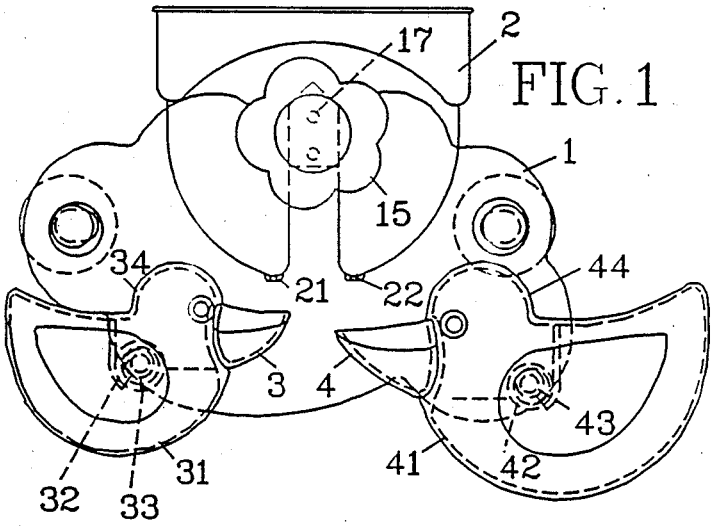
FIG. 1
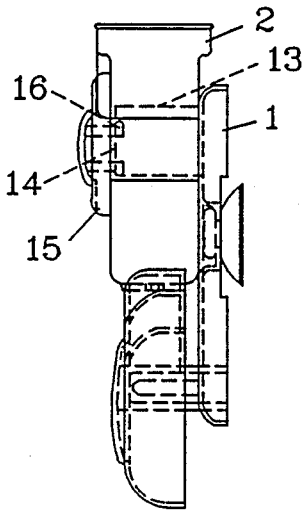
FIG. 2
FIG. 3
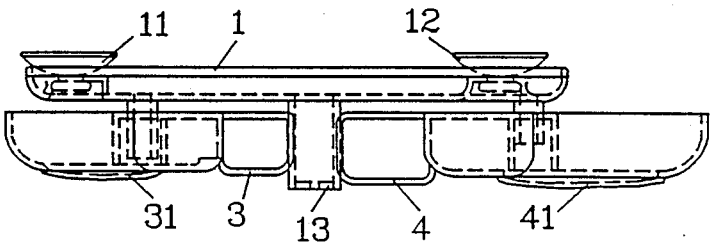

WATER TOY

BACKGROUND OF THE INVENTION

The invention refers to a water toy for children, which not only serves as a toy, but which also has an educational quality.

Toys on one hand have the purpose of satisfying the play desire of the child, and on the other hand also of developing the feeling for form as well as the insight into or at least a conception of the physical course of events. The latter particularly applies to mobile toys, i.e. those, which make movements as a result of energy supply.

PURPOSE AND MOST ESSENTIAL FEATURES OF THE INVENTION

The present invention refers to a toy of the lat mentioned kind, i.e. a water toy, the movement of which is caused by supply of water, and its purpose is to provide a simple toy of this type, which gives the child a conception of the mechanical balance and the consequences of an unbalance intentionally caused to a body.

The first water tank is fixed to a base plate and has at least one opening. A second water tank is provided below the outlet opening and is preferably formed as a figurine which is freely pivotably supported about a pivot axis which extends perpendicularly with respect to the base plate. When the second water tank is empty, the figurine is in a balanced position. When the second water tank is at least party filled, the figurine becomes unbalanced and pivots to empty the second water tank.

The second water tank, which is pivotably arranged below the first water tank, is in unfilled condition in balance, i.e. the pivot axis extends through the centre of gravity of the empty water tank. This however is designed in such a manner that it can not maintain the earlier balance, when receiving water from the outlet opening of the first water tank situated thereabove, as it is partly or entirely positioned on one side of the pivot axis. By increasing supply of water, the further water tank now turns the pivot axis, but it can in a specific position of inclination empty itself again, as its edge is suitably designed. Due to the emptying, the intital weight distribution relative to the pivot axis will again be resumed, whereby the further water tank returns to the initial position. Due to further water supply from the first water tank, the process repeats itself, thus that the further water tank makes a rocking motion.

Of particular interest is the rocking motion, which first is slow, i.e. up to the beginning of the pivoting movement caused by the unbalance, but which when reaching a specific pivoting position is completed swiftly till the figurine is in the tilting position, whereby the further water tank empties itself abruptly. This is achieved either therein, that the weight, i.e. the mass of the further water tank is unevenly distributed relative to the pivot axis in the sense, that after reaching a certain pivotal angle a mass concentration, e.g. an area of particularly big wall thickness, which up until this moment has counteracted the force of the increasing water filling, now passes the pivot axis. Hereby the unbalanced wieght increases abruptly on the side where water is filled, whereby a swift displacement of the further water tank to the desired tilting position is obtained.

This phenomenon can also be obtained in a particularly simple manner in that the further water tank is supported on a journal projecting from the base plate and forming the pivot axis, and having such a big bearing bore, that a considerable play is present between them. The play is so big that no relative movement is obtained between the journal and the bearing bore at the beginning of the pivoting motion, but the bearing bore surface will roll on the outer surface of the journal. Due to this rolling rolling, the supporting point of the further water tank displaces itself on the bearing journal to the side, which is filled with water. If the displacement reaches a level at which the friction prevailing between bearing surface and journal is no longer sufficient for supporting on the outer surface of the journal, which is always steeply sloping, then the further water tank moves on the bearing journal to the side, which is filled with water and thereby increases the lever of the water filled side abruptly. Thereby arises the desired abrupt tilting of the water tank to its tilting position, wherein it empties itself. After the emptying there again exists a sufficient big unbalanced weight, whereby the further water tank can resume its original, balanced position.

The educational effect of the water toy according to the invention can be increased when the first water tank has several outlet openings with different opening cross sections, and that each outlet opening is associated with a further water tank, which can be designed in the manner described. Due to the different areas of the outlet openings, the further water tanks are supplied with different water quantities during one unit of time, whereby—when the further water tanks have equal volumes-the time until reaching the tilting position will be of different length. The child will thereby observe the quantity of water required for achieving a sufficiently big unbalance for obtaining emptying. The same effect can be obtained when the plurality of outlet openings in the first water tank have equal opening areas, whereas the volumes of the further water tanks are different. There also can be a combination of these two embodiments.

In order to make the use of the water toy according to the invention as simple as possible, suction cups are provided on the rear side of the base plate, by means of which the water toy may be fitted below a faucet on a wall, e.g. on a bath tub wall.

It furthermore may be possible to arrange the first water tank pivotably on the base plate. This is appropriate, when the first water tank has several outlet openings with different opening areas and which furthermore is subdivided by a partition, so that each outlet opening is associated with a tank portion. At interrupted water supply from above the tank portions therefor empty themselves at different speeds, thus that during the emptying an unbalance is effected also at the first water tank, which results in a pivoting. If the amplitude of this pivoting is so big, that one or more of the further water tanks situated therebelow is moved out of the area of the jet of water from the outlet opening provided thereabove, then there is is no further filling and the rocking motion thereof and of this water tank are terminated.

BRIEF DESCRIPTION OF THE DRAWINGS

An embodiment of the water toy according to the invention is further described in the following with reference to the accompanying drawings. In the drawings is shown:

FIG. 1 a front view of the water toy;

FIG. 2 a side view, and

FIG. 3 a view from above, from which the first water tank has been excluded for the sake of clarity.

DETAILED DESCRIPTION OF THE PREFERRED EMBODIMENTS

The water toy shown in the drawings mainly comprises a base plate 1, the contours of which can be seen in FIG. 1, a first water tank 2 and two further water tanks 3 and 4 resp., designed as bills of bird figurines. The base plate 1 at its rear side has two suction cups 11, 12, by means of which it can be simply, i.e. only by pressing, fitted to a smooth wall below a not shown faucet in such a manner, that water flowing from the faucet enters the upwardly open water tank 2.

The first water tank 2 mainly has the shape of a hopper and is supported on a tubular journal 13 which projects from the base plate 1. The tank 2 is closed by a front wall 14. A rosette 15 has elastically bendable arms 16, which at their free ends carry hook members (FIG. 2). The arms 16 can be pushed into openings 17 in the front wall 14, so they elastically snap into these and the rosette 15 in this manner arrests the first water tank 2.

The lower end of the water tank 2 is provided with two outlet openings 21, 22, whereof e.g. the outlet opening 21 has a bigger opening area than the outlet opening 22. Directly below the outlet openings 21, 22 are arranged the collecting water tanks 3, 4 which are designed as bills. The bird figurines 31 and 41 which have main bodies and whereof the water tanks 3, 4 form the bills fixed to the sides of the main bodies, are supported by means of bearing bores 32, 42 each arranged upon a bearing journal or pivot pins 33 and 34 resp. projecting from the base plate 1. The bearing journals 33, 43 have such a length, that there is required no specific fixing for preventing the bird figurines from falling out. The bearing journals 33, 43 are generally perpendicular to the base plate 1 and can possibly extend slightly upwards, whereby the bird figurines 31, 41 during their movement tend to approach the base plate 1.

As can be seen from FIG. 1, the bearing journals 33, 43 are arranged just about in the centre of gravity of the bird figurines, as long as their bills 3, 4 are not filled with water. Furthermore the diameter of the bearing journals 33, 43 is considerably smaller than the diameters of the bearing bores 32, 42 (FIG. 1). The pivot axes formed by the bearing journals 33, 43 finally are arranged so in relation to the heads of the bird figurines 31, 41, that the wall area 34 and 44 resp. extending upwards on the rear part of the head is positioned at the opposite side from the balance position shown in FIG. 1 relative to the water tanks 3 and 4 resp.. The wall area 34, 44 facing upwards or head portion of the bird-shaped figurines forms a material accumulation, which already after a short pivoting movement of the bird figurines 31, 41 to the side of the water tanks 3, 4, reach their side relative to the pivoting axis.

The function of the water toy is the following: if the water toy is fixed by means of the suction cups 11, 12 under a faucet in the manner described, the first water tank 2 can be filled with water. Due to the different opening areas in the outlet openings 21, 22, different volumes of water leave these openings during a unit of time and therefor fill the water tanks 3, 4 at different speeds. This filling at different speeds is also further increased, if the volume of the water tank 3 is smaller than that of the water tank 4 (compare FIGS. 1, 2). Due to the increasing volume of water in the water tanks 3, 4, the bird figurines 31, 41 begin to become more and more inclined towards their bill side. This inclination results in a rolling of the inner surface of the bearing bores 32, 42 on the outer surface of the bearing journals 33, 43 almost without any relative displacement. As the support point between bearing surface and bearing journal during this rolling motion reaches a more and more steeply sloping circumferential surface on the bearing journal, a point is soon reached, in which the friction between these surfaces is not sufficient for supporting the bird figurines 31, 41. Therefore an abrupt sliding results, whereby the bird figurines 31, 41 will approach each other slightly. Due to this sliding, the lever with which the water tank 3, 4 attacks the pivoting axis becomes longer, whereby now a further pivoting movement abruptly begins up to a tilting position, in which the water contained in the water tanks 3, 4 can be emptied over the edge of the tanks. The bottom shape of the water tanks 3, 4 shown in FIG. 1 contributes to the swift emptying. The desired abrupt further tilting of the bird FIGS. 31, 41 is supported thereby, that the desired mass accumulations 34, 44 after a short pivoting angle trespasses the pivot axis and then causes a further increased weight load on the water tank 3, 4 side. After emptying, the bird FIGS. 31, 41 move back to their initial position according to FIG. 1 due to the unbalance now occuring, whereupon the described process is repeated. Hereby is caused the impression of a swing, which increases the play impulse.

The present invention may be embodied in other specific forms without departing from the spirit or essential attributes thereof. Accordingly, reference should be made to the appended claims, rather than to the foregoing specification, as indicating the scope of the invention.

What I claim is:

1. A water toy, comprising:

(A) a base which includes a pivot member;

(B) a main tank connected to the base, the tank including: (1) a first outlet for draining water from the tank at a first flow rate and (2) a second outlet for draining water from the tank at a second flow rate, the second flow rate being different from the first flow rate;

(C) a first pivotable object, including: (1) a main body, (2) a first collecting tank for collecting water drained through the first outlet, and (3) bearing means for pivotably supporting the object on the pivot member, the bearing means being located within the main body so that (a), when the collecting tank is empty, the object is balanced with the collecting tank in position to collect water drained through the first outlet and (b), as the collecting tank collects water, the object becomes unbalanced and pivots by gravity around the pivot member to an unbalanced position in which water is emptied from the collecting tank, the bearing means cooperating with the pivot member so that, as the object pivots around the pivot member, a surface of the bearing means slides across the pivot member to further unbalance the object to increase the abruptness of the pivoting of the object; and (D) a second pivotable object which includes a second collecting tank for collecting water drained through the second outlet, the second object being pivotably supported with respect to the base so that (a), when the second colleting tank is empty, the second object is balanced with the second collecting tank in position to collect water drained through the second outlet and (b), as the second collecting tank collects water, the second object becomes unbalanced and pivots by gravity to an unbalanced position in which water is emptied from the second collecting tank.

2. The invention of claim 1, wherein the pivot member includes a pin.

3. The invention of claim 2, wherein the bearing means includes a bearing bore, the bore having a greater diameter than the pin so that, as the first object pivots around the pivot member, a surface of the bore slides across the pin to further unbalance the first object to increase the abruptness of the pivoting of the first object.

4. The invention of claim 1, wherein the mass of the first object is distributed so as to further increase the abruptness of the pivoting of the first object.

5. The invention of claim 4, wherein the first object has the shape of a bird with a head portion which is located between the first collecting tank and the bearing means so as to distribute the mass of the first object to increase the abruptness of the pivoting of the first object.

6. An educational water toy, comprising:

(A) a base plate;

(B) a main tank connected to the base plate, the tank including:

(1) a first outlet opening for draining water from the tank at a first flow rate; and (2) a second outlet opening for draining water from the tank at a second flow rate, the second flow rate being different from the first flow rate;

(C) first and second pivot pins fixed to the base plate, the pivot pins being generally perpendicular to the base plate;

(D) a first figurine, including:

(1) a first main body;

(2) a first collecting tank for collecting water drained from the first outlet opening, the collecting tank being fixed to a side of the main body; and (3) a first bearing bore for pivotably supporting the figurine on the first pivot pin, the bearing bore being located within the main body so that (a) when the collecting tank is empty, the figurine is balanced with the collecting tank in position to collect water drained from the main tank through the first outlet opening and (b) as the collecting tank collects water drained from the main tank, the figurine becomes unbalanced and pivots by gravity around the first pivot pin to an unbalanced position in which water is emptied from the collecting tank; and (E) a second figurine, including:

(1) a second main body;

(2) a second collecting tank for collecting water drained from the second outlet opening, the second collecting tank being fixed to a side of the second main body; and (3) a second bearing bore for pivotably supporting the second figurine on the second pivot pin, the second bearing bore being located within the second main body so that (a) when the second collecting tank is empty, the second figurine is balanced with the second collecting tank in position to collect water drained from the main tank through the second outlet opening and (b) as the second collecting tank collects water drained from the main tank, the second figurine becomes unbalanced and pivots by gravity around the second pivot pin to an unbalanced position in which water is emptied from the second collecting tank;

each of the bearing bores having a greater diameter than the diameter of the respective pivot pins so that when the figurines become unbalanced and pivot around the pivot pins, the surfaces of the bearing bores slide across the pivot pins to further unbalance the figurines to increase the abruptness of the pivoting of the figurines;

the mass of each of the figurines being distributed so as to further increase the abruptness of the pivoting of the figurines.

7. The invention of claim 6, wherein the base plate includes suction cups for attaching the toy to a wall beneath a faucet.

8. The invention of claim 6, wherein the main tank is pivotably connected to the base plate.

9. The invention of claim 8, wherein the main tank includes a partition between the first and second outlet openings.

10. The invention of claim 6, wherein the pivot pins extend slightly upwardly to maintain the figurines thereon.

11. The invention of claim 6, wherein each of the figurines has the shape of a bird.

12. The invention of claim 11, wherein the figurines each include a head portion which is located between the collecting tanks and the bearing bores so as to distribute the mass of the figurines to increase the abruptness of the pivoting of the figurines.

13. A water toy, comprising:

(A) a base which includes a pivot member;

(B) a main tank connected to the base;

(C) a first pivotable object, including: (1) a main body, (2) a first collecting tank for collecting water drained from the main tank, and (3) bearing means for pivotably supporting the object on the pivot member, the bearing means being located within the main body so that (a), when the collecting tank is empty, the object is balanced with the collecting tank in position to collect water drained from the main tank and (b), as the collecting tank collects water, the object becomes unbalanced and pivots by gravity around the pivot member to an unbalanced position in which water is emptied from the collecting tank, the bearing means cooperating with the pivot member so that, as the object pivots around the pivot member, a surface of the bearing means slides across the pivot member to further unbalance the object to increase the abruptness of the pivoting of the object; and (D) a second pivotable object which includes a second collecting tank for collecting water drained from the main tank, the second collecting tank having a greater volume than the first collecting tank, the second object being pivotably supported with respect to the base so that (a), when the second collecting tank is empty, the second object is balanced with the second collecting tank in position to collect water drained from the main tank and (b), as the second collecting tank collects water, the second object becomes unbalanced and pivots by gravity to an unbalanced position in which water is emptied from the second collecting tank.

14. The invention of claim 13, wherein the pivot member includes a pin.

15. The invention of claim 14, wherein the bearing means includes a bearing bore, the bore having a greater diameter than the pin so that, as the first object pivots around the pivot member, a surface of the bore slides across the pin to further unbalance the first object to increase the abruptness of the pivoting of the first object.

16. The invention of claim 13, wherein the mass of the first object is distributed so as to further increase the abruptness of the pivoting of the first object.

17. The invention of claim 16, wherein the first object has the shape of a bird with a head portion which is located between the first collecting tank and the bearing means so as to distribute the mass of the first object to increase the abruptness of the pivoting of the first object.

18. An educational water toy, comprising:

(A) a base plate;

(B) a main tank connected to the base plate, the tank including first and second outlet openings for draining water from the tank;

(C) first and second pivot pins fixed to the base plate, the pivot pins being generally perpendicular to the base plate;

(D) a first figurine, including:

(1) a first main body;

(2) a first collecting tank for collecting water drained from the first outlet opening, the collecting tank being fixed to a side of the main body; and (3) a first bearing bore for pivotably supporting the figurine on the first pivot pin, the bearing bore being located within the main body so that (a) when the collecting tank is empty, the figurine is balanced with the collecting tank in position to collect water drained from the main tank through the first outlet opening and (b) as the collecting tank collects water drained from the main tank, the figurine becomes unbalanced and pivots by gravity around the first pivot pin to an unbalanced position in which water is emptied from the collecting tank; and (E) a second figurine, including:

(1) a second main body;

(2) a second collecting tank for collecting water drained from the second outlet opening, the second collecting tank being fixed to a side of the second main body, the second collecting tank having a greater volume than the first collecting tank; and (3) a second bearing bore for pivotably supporting the second figurine on the second pivot pin, the second bearing bore being located within the second main body so that (a) when the second collecting tank is empty, the second figurine is balanced with the second collecting tank in position to collect water drained from the main tank through the second outlet opening and (b) as the second collecting tank collects water drained from the main tank, the second figurine becomes unbalanced and pivots by gravity around the second pivot pin to an unbalanced position in which water is emptied from the second collecting tank;

each of the bearing bores having a greater diameter than the diameter of the respective pivot pins so that when the figurines become unbalanced and pivot around the pivot pins, the surfaces of the bearing bores slide across the pivot pins to further unbalance the figurines to increase the abruptness of the pivoting of the figurines;

the mass of each of the figurines being distributed so as to further increase the abruptness of the pivoting of the figurines.

19. The invention of claim 18, wherein the base plate includes suction cups for attaching the toy to a wall beneath a faucet.

20. The invention of claim 18, wherein the main tank is pivotably connected to the base plate.

21. The invention of claim 20, wherein the main tank includes a partition between the first and second outlet openings.

22. The invention of claim 18, wherein the pivot pins extend slightly upwardly to maintain the figurines thereon.

23. The invention of claim 18, wherein each of the figurines has the shape of a bird.

24. The invention of claim 23, wherein the figurines each include a head which is located between the collecting tanks and the bearing bores so as to distribute the mass of the figurines to increase the abruptness of the pivoting of the figurines.

* * * * *